US007143960B2

(12) United States Patent
Joseph et al.

(10) Patent No.: US 7,143,960 B2
(45) Date of Patent: Dec. 5, 2006

(54) LIQUID SAMPLE RESERVOIR SUITABLE FOR USE WITH A SPRAYING APPARATUS

(75) Inventors: Stephen C. P. Joseph, Woodbury, MN (US); Malcolm F Douglas, Wales (GB)

(73) Assignee: 3M Innovative Properties Company, St. Paul, MN (US)

( * ) Notice: Subject to any disclaimer, the term of this patent is extended or adjusted under 35 U.S.C. 154(b) by 22 days.

(21) Appl. No.: 10/471,709

(22) PCT Filed: Mar. 14, 2002

(86) PCT No.: PCT/US02/07963

§ 371 (c)(1),
(2), (4) Date: Feb. 2, 2004

(87) PCT Pub. No.: WO02/072276

PCT Pub. Date: Sep. 19, 2002

(65) Prior Publication Data

US 2004/0118941 A1 Jun. 24, 2004

(30) Foreign Application Priority Data

Mar. 14, 2001 (GB) ..... 0106199.3

(51) Int. Cl.
*B05B 9/00* (2006.01)
*B05B 7/30* (2006.01)
*A62C 13/62* (2006.01)

(52) U.S. Cl. ..... 239/379; 239/302; 239/345; 239/344; 239/354; 239/1; 239/11

(58) Field of Classification Search ..... 239/346, 239/302, 329, 345, 375–379, DIG. 14, 344, 239/304, 342, 354, 1, 11, 600; 141/27, 383; 222/95, 105, 83
See application file for complete search history.

(56) References Cited

U.S. PATENT DOCUMENTS

| | | | |
|---|---|---|---|
| 1,703,384 | A | 2/1929 | Birkenmaier |
| 2,177,032 | A | 10/1939 | Baumgardner |
| 2,264,564 | A | 12/1941 | Connor |
| 3,198,438 | A | 8/1965 | Hultgren |

(Continued)

FOREIGN PATENT DOCUMENTS

| | | | |
|---|---|---|---|
| AU | 200032550 | A | 7/2000 |

(Continued)

OTHER PUBLICATIONS

Service Bulletin, SB-4-043-D, Replaces SB-4-043-C, DeVilbiss, "120175 (GFC-202) 32 oz. Aluminum Gravity Feed Cup with Disposable Lid and Cup Liner", May, 2000. (*53022).

*Primary Examiner*—Davis Hwu
(74) *Attorney, Agent, or Firm*—Pamela L. Stewart; Douglas B. Little

(57) ABSTRACT

A single use, disposable reservoir of low volume for use in conjunction with a spray gun for spray painting small areas, for example 'spray out' cards for color matching a paint mix for spray painting a vehicle. The reservoir is in the form of a syringe body with a plunger having a sealing member slidable within the body for drawing paint into the body via an open end. The body has an aperture adjacent to a closed end and the plunger can be moved to position the sealing member between the aperture and closed end for releasing a partial vacuum created when the paint is drawn into the body and allow the paint to be withdrawn, in use, when the reservoir is connected to a spray gun without actuating the plunger. In other embodiments, the reservoir comprises a concertina-type body or a pipette body.

16 Claims, 6 Drawing Sheets

U.S. PATENT DOCUMENTS 3,211,324 A 10/1965 Sapien
3,227,305 A 1/1966 Enssle
3,236,459 A 2/1966 McRitchie
3,255,972 A 6/1966 Hultgren et al.
3,401,842 A 9/1968 Morrison
3,432,104 A 3/1969 Kaltenbach
3,507,309 A 4/1970 Johnson
3,757,718 A 9/1973 Johnson
3,773,211 A 11/1973 Bridgman
3,780,950 A 12/1973 Brennan
3,784,039 A 1/1974 Marco
3,790,017 A 2/1974 Fitzpatrick et al.
3,790,021 A 2/1974 Bailey
3,934,746 A 1/1976 Lilja
4,043,510 A 8/1977 Morris
4,122,973 A 10/1978 Ahern
4,137,952 A * 2/1979 Rendemonti ..... 141/27
4,151,929 A 5/1979 Sapien
4,204,645 A * 5/1980 Hopp ..... 239/341
4,321,922 A 3/1982 Deaton
4,339,046 A 7/1982 Coen
4,347,948 A 9/1982 Hamada et al.
4,379,455 A 4/1983 Deaton
4,383,635 A 5/1983 Yotoriyama
4,403,738 A 9/1983 Kern
4,406,406 A 9/1983 Knapp
4,558,792 A 12/1985 Cabernoch et al.
4,562,965 A 1/1986 Ihmels et al.
4,586,628 A 5/1986 Nittel
4,657,151 A 4/1987 Cabernoch
4,723,712 A 2/1988 Egli et al.
4,760,962 A 8/1988 Wheeler
4,811,904 A 3/1989 Ihmels et al.
4,813,556 A 3/1989 Lawrence
4,836,764 A 6/1989 Parkinson
4,930,644 A 6/1990 Robbins, III
4,936,511 A 6/1990 Johnson et al.
4,951,875 A 8/1990 Devey
4,971,251 A 11/1990 Dobrick et al.
5,052,623 A 10/1991 Nordeen
5,069,389 A 12/1991 Bitsakos
5,094,543 A 3/1992 Mursa
5,123,571 A 6/1992 Rebeyrolle et al.
5,143,242 A 9/1992 Millasich
5,143,294 A 9/1992 Lintvedt
5,186,828 A 2/1993 Mankin
5,209,501 A 5/1993 Smith
5,328,095 A 7/1994 Wickenhaver
5,337,921 A 8/1994 Wilson et al.
5,385,251 A 1/1995 Dunn
5,405,090 A 4/1995 Greene et al.
5,424,086 A 6/1995 Walker
5,454,488 A 10/1995 Geier
5,460,289 A 10/1995 Gemmell
5,492,242 A 2/1996 Gall
5,582,350 A 12/1996 Kosmyna et al.
5,607,082 A 3/1997 Cracauer
5,617,972 A 4/1997 Morano et al.
5,655,714 A 8/1997 Kieffer et al.
D386,654 S 11/1997 Kosmyna
5,772,079 A 6/1998 Gueret
5,789,684 A 8/1998 Masek et al.
5,797,520 A 8/1998 Donahue
5,806,711 A 9/1998 Morano et al.
5,816,501 A 10/1998 LoPresti et al.
5,829,588 A 11/1998 Bloomfield
5,853,102 A 12/1998 Jarrett
5,996,427 A 12/1999 Masek et al.
6,019,294 A 2/2000 Anderson et al.
6,053,429 A 4/2000 Chang
6,092,740 A 7/2000 Liu
6,095,435 A * 8/2000 Greer et al. ..... 239/369
6,196,410 B1 3/2001 Hocking
6,257,429 B1 7/2001 Kong
6,536,687 B1 3/2003 Navis et al.
6,820,824 B1 * 11/2004 Joseph et al. ..... 239/346

FOREIGN PATENT DOCUMENTS

AU 199935838 A 1/2001
CA 963436 2/1975
CA 965388 4/1975
CA 1006450 3/1977
CA 1192852 9/1985
CA 2099763 7/1992
CH 540159 A 8/1973
CH 653574 1/1986
CH 688082 A5 5/1997
DE 27 32 049 1/1978
DE 2900998 7/1980
DE 29 44 653 A 5/1981
DE 34 09 961 A1 9/1985
DE 3439442 4/1986
DE 35 17 122 C 5/1986
DE 4102326 7/1992
DE 4209258 A1 9/1993
DE 19618514 A1 11/1997
DE 29905100 U1 6/1999
DE 201 17 496 U1 2/2002
EP 0 300 762 1/1989
EP 0 536 344 4/1993
EP 636548 B1 2/1995
EP 0 678 334 10/1995
EP 0 689 825 A1 1/1996
EP 0 847 809 A1 6/1998
EP 0 987 060 A1 3/2000
FR 2 510 069 1/1983
FR 2639324 5/1990
FR 2 669 306 5/1992
GB 2103173 2/1983
GB 2 170 471 8/1986
JP 01 027659 A 1/1989
JP 64-27659 1/1989
JP 6-335643 12/1994
JP 08192851 A 7/1996
JP 10007170 A 1/1998
JP 11028394 A 2/1999
JP 1999-347462 12/1999
JP 2001252599 9/2001
SU 1088812 4/1984
WO WO 92/11930 7/1992
WO WO 92/14437 9/1992
WO WO 95/11170 A1 4/1995
WO WO 98/32539 A1 7/1998
WO WO 99/06301 A1 2/1999
WO WO 99/50153 A1 10/1999

* cited by examiner

LIQUID SAMPLE RESERVOIR SUITABLE FOR USE WITH A SPRAYING APPARATUS

TECHNICAL FILED

This invention relates to containers. More particularly, but not exclusively, it relates to a container which is a liquid sample reservoir suitable for use with apparatus for spraying a liquid. Even more particularly, but not exclusively, it relates to a said liquid sample reservoir which is disposable.

BACKGROUND

Spray guns, as used in vehicle body shops for example, are well known and comprise a reservoir in which a liquid to be dispensed is contained, and a spray nozzle through which the liquid is dispensed, typically under pressure, under the control of a trigger mechanism, see for example FIG. 1. The liquid may be fed from the reservoir under gravity and/or it may be entrained in a stream of pressurised fluid, for example air and water, which is supplied to the gun from an external source.

The spraying of colour match test cards (also known as spray out cards), or small areas of vehicles, is often carried out prior to the painting of a whole vehicle. Test cards, see for example FIG. 3, are typically made from cardboard, metal or plastic and can have a comparison hole, typically 7 mm in diameter, cut through them and an opacity check region. Paint to be sprayed onto the test card is premixed from commercially available tinters, typically mixed in small volume containers such as, for example, plastic or paper cups, and an aliquot is loaded into the spray gun. A sufficient number of coats of the paint, which may be either solvent based or water based, to totally obscure the opacity check region are sprayed onto the card. The card is then baked dry and a number of coats of a lacquer, which is typically solvent based, are applied over the paint. The lacquer is then baked dry and the paint compared to the desired colour through the comparison hole by overlaying the card onto a panel of the vehicle having the desired colour.

Small test aliquots of paint are generally taken from large batches of mixed pigments in order to increase the uniformity of the mixture as any error in mixing the pigments to make the paint mixture is amplified by the use of small weights in mixing, for example, a 5 g error in mixing 50 g of paint is a 10% error whereas the same weight error in mixing 500 g represents only 1% error in pigment mix. Weight measurements have been found to be more accurate than volumetric measurements for mixing purposes. However, if a standard, large volume, paint reservoir is used on the spray gun to spray a test piece and the paint is not a good match a large amount of cleaning of the system is required prior to spraying another test piece with a retinted paint mixture in order to prevent cross-contamination between the two paint mixtures. The cleaning of the system is a time consuming, labour intensive operation, increases the amount of solvents used and can also expose users to noxious solvent vapours. One solution to this problem, the use of a disposable paint reservoir liner, see for example FIG. 2, has been discussed in the PCT Application No. PCT/US98/00796 published under No. WO 98/32539 which is assigned to the Minnesota Mining and Manufacturing Company and the contents of which are incorporated herewith by reference.

The use of standard size beverage cups for mixing also reduces the opportunities for cross-contamination between colours as the cups are readily disposed of after use and a new cup is used for each colour. This can lead to large variations in colour between small volume paint mixes and large volume paint batches which are ostensibly the same colour.

The use of small volume containers, such as for example cups, for the mixing of paints does however have a number of problems associated with it. The containers are typically open to their surroundings which can lead to contamination of the paint, generally by particulates or, less likely, by water. The particulates may block the flow path or spray nozzle of the spray gun thereby preventing the spraying of the test card or vehicle and necessitate a complete strip down, clean and overhaul of the spray gun. The introduction of water into a non-water based paint mixture can lead to the formation of a two-phase system or an emulsion that results in an uneven flow rate due to the differing hydrodynamic properties of the paint mixture and water.

Another problem associated with the use of small, open containers such as cups for colour mixing purposes is that it requires the transfer of the pigments from storage containers to the container in order to achieve the desired shade. This can entail the use of jugs that must be thoroughly cleaned with solvents after each use in order to prevent cross-contamination between pigments. The solvents employed in the cleaning process are often inflammable, noxious and/or poisonous and therefore it is desired to minimise their usage wherever possible both for environmental and health reasons.

Different batches of a colour made to ostensibly the same recipe, from ostensibly the same pigments, will typically vary slightly in coloration. Therefore it is usual practice to mix a large batch of a given colour and make variations to the mixture of this large batch and transfer a small amount of the batch to the spray gun reservoir for colour matching purposes. However, varying the paint mixture in the reservoir to achieve a colour match and to "scale up" these variations to the batch in order to attempt to achieve a colour match in the large batch is not always successful for the reasons discussed hereinbefore.

Another problem of current paint mixing arrangements is that should a customer wish to retain a small amount of the paint, for example, for possible "touching up" of any future scratches to their vehicle, the paint must be transferred to a sealable container for them. This again raises the problems of contamination of the paint by particulates and also the need to dispose of the reservoir after use.

A paint feed system is disclosed in JP 11290728 comprising a pair of piston/cylinder units operable in tandem to provide a continuous supply of paint to a robotic spray gun. The piston of each unit is driven by a servomotor under the control of a controller to connect alternately the units to the paint supply and spray gun. In this way, one unit takes up paint as the piston is retracted and the other unit delivers paint as the piston is advanced. This system is designed for continuous supply of paint of one colour and is not suitable for rapid changing over between colours due to the extensive cleaning of the units and supply lines that would be required. It is also designed for use with a remote spray gun such as carried by a robot arm and is neither intended nor capable of being used with a hand-held spray gun.

SUMMARY

It is an aim of the present invention to provide a fluid reservoir which, in an embodiment thereof, at least partly, ameliorates at least one of the above-mentioned problems.

It is a further desired aim of the present invention to provide a fluid reservoir that is lightweight, of simple construction and facilitates changeover of spraying apparatus to spray different fluids with reduced cleaning required to avoid cross-contamination.

It is yet another desired aim of the present invention to provide a fluid reservoir that can be charged manually with the fluid to be sprayed and allows the fluid to be withdrawn without requiring actuation by the user or any other applied force when the reservoir is connected to the spraying apparatus.

It is a still further desired aim of the present invention to provide a single use, disposable fluid reservoir for use with hand held spraying apparatus whereby the reservoir can be detached and thrown away after use.

It is another desired aim of the present invention to provide a fluid reservoir for supplying a relatively small volume of fluid suitable for spraying a small area such as when test spraying for colour matching purposes.

Other aims and objects of the present invention will be apparent from the description hereinafter of exemplary embodiments.

According to a first aspect of the present invention there is provided a fluid reservoir for a spray gun, the reservoir comprising a body having a first, substantially closed end and a second, open end, the open end being connectable, in use, to a spray gun, and a vacuum forming element operable to create at least a partial vacuum within the body for drawing fluid into the reservoir via the open end when disconnected from the spray gun characterised in that means is provided for controlling said at least partial vacuum whereby, when the open end of the reservoir is connected to the spray gun, fluid can be withdrawn from the reservoir via the open end for supply to the spray gun independently of an actuation force applied to the vacuum forming element externally of the reservoir.

By this invention, the vacuum forming element is operable to draw up a required volume of fluid, typically paint, into the reservoir arid the partial vacuum created thereby is controlled so that the fluid can be withdrawn for supply to a spray gun without actuating the vacuum forming element to expel the fluid from the reservoir. This facilitates use of the reservoir with a hand-held spray gun of the type employed in vehicle body repair shops by avoiding any manual actuation of the reservoir by the operator to transfer the paint to the spray gun while spray painting.

In a first embodiment, the body may be a syringe body and the vacuum forming element may be a plunger having a sealing member resident in the body and a shank passing through an opening in the first end for manual actuation of the plunger.

The sealing member frictionally engages a wall of the body to divide the syringe body into two chambers and is slidable in the axial direction of the body in response to actuation of the plunger to vary the relative volumes of the two chambers. In this way, movement of the sealing member away from the second, open end towards the first end creates a partial vacuum (pressure differential relative to atmospheric pressure) in the body for drawing fluid into the reservoir, in use.

The means for controlling the partial vacuum may be an aperture through the wall of the body. The aperture will typically be proximate the first end of the body and, in use, may allow the passage of air into/out of the body, as the plunger is entered into/withdrawn from the body. The aperture allows a sufficient intake/expelling of air that there is not a vacuum/build up of pressure to such an extent that the plunger has its translation restricted by a pressure differential. This is important, as there will generally be little clearance between the opening in the first end and the plunger so as to limit the opportunity for the ingress of particles into the reservoir.

In use, the plunger may be drawn to a first position where the sealing member is between the second, open end of the body and the aperture to create the at least partial vacuum to draw fluid into the reservoir and retain the fluid in the reservoir. The plunger may then be drawn to a second position, after attachment to the spray gun, where the sealing member is between the aperture and the first, substantially closed end to release the at least partial vacuum. This allows air to enter the syringe as fluid is withdrawn from the reservoir by the spray gun, whilst limiting the opportunities for contamination of the paint. Thus, paint can be drawn from the reservoir via the open end by the spray gun without an actuation force being applied to the plunger externally of the reservoir to move the sealing member towards the second, open end. As a result, the operator only has to actuate the spray gun trigger in the normal manner and no additional actuation of the reservoir is required to transfer the paint from the reservoir to the spray gun. This gives the operator freedom to position the spray gun to direct the spray onto the surface to be coated without any adverse effect on the paint supply to the spray gun.

Alternatively, or additionally, the means for controlling the at least partial vacuum may be a passageway passing through the plunger. The passageway may extend from the sealing member within the body to a position externally of the body. The passageway may be releasably sealed externally of the body by a cover. The cover may frictionally engage the plunger. Alternatively, the cover may be pivotally mounted with respect to the plunger. In this way, the passageway may be sealed to create, in use, the at least partial vacuum to draw fluid into the reservoir as the plunger is withdrawn. The cover may then be released to open the passageway and release the at least partial vacuum. This allows air to enter the syringe as fluid is withdrawn from the reservoir by the spray gun, whilst limiting the opportunities for contamination of the paint. Thus, paint can be drawn from the reservoir via the open end by the spray gun without an actuation force being applied to the plunger externally of the reservoir to move the sealing member towards the second, open end.

The second, open end of the body may have a mounting extending therefrom. A closure may be provided for releasably closing the mounting. The closure may be a cap. The mounting and the cap may have complementary screw threads so as to be able to be screwed together, in use. Alternatively, the closure may frictionally engage an internal wall of the mounting, in use. These closure arrangements allow small volumes of paint to be stored, for example, either to aid in subsequent colour matching or to allow customers to take small amounts of paint so that they can "touch up" small scratches or flaws in their vehicles paint work.

In another embodiment, the body may be a collapsible body. The body may be a concertina type arrangement, for example the body may be a bellows. The vacuum forming element may be an integral part of the body. The body may have an open end and a closed end. The closed end may constitute the vacuum forming element with the open end permitting fluid to be drawn into and expelled from the body. The open end may have a mounting, as detailed hereinbefore, to which a releasable closure, as detailed hereinbefore, may be affixed. This is a convenient, typically disposable, way of providing a liquid reservoir.

In use, the body may be collapsed and subsequently extended to create the at least partial vacuum to draw fluid into the body through the open end. The body may then be attached to a spray gun and the vacuum controlled by collapse of the body as fluid is withdrawn from the reservoir by the spray gun. In this way, the fluid can be withdrawn without an actuation force being applied to the closed end (vacuum forming element) externally of the reservoir. In a modification, the closed end may be provided with an aperture that is normally closed but can be opened to release the at least partial vacuum and assist collapse of the body as fluid is withdrawn from the reservoir.

In yet another embodiment, the body may be a pipette. The body may have a distended portion between the first and second ends. The distended portion may, in use, serve as a reservoir. The vacuum forming element may be a pipette bulb. The bulb may be integrally formed with the pipette. Alternatively, the vacuum forming element may be a pipette safety filler. The open end may have a mounting, as detailed hereinbefore, to which a closure, as detailed hereinbefore, may be affixed.

In use, the vacuum forming element may be actuated to create the at least partial vacuum within the body to draw fluid into the body through the open end. The body may then be attached to the spray gun and the at least partial vacuum released, for example by opening an air passageway, to allow the fluid to be withdrawn from the body without application of an actuation force to the vacuum forming element externally of the reservoir.

An adapter may be provided for enabling any of the embodiments detailed hereinbefore to be attached to a spray gun, in use. The adapter may be releasably attached to the mounting and adapted, in use, to be received releasably in a mount of the spray gun.

The reservoir may have a filter. The filter may be positioned internally or externally of the reservoir for removing particulates when drawing fluid into the reservoir and/or when withdrawing fluid from the reservoir. The filter may be positioned over the open end of the reservoir. The filter may, or may not, be removed from the reservoir prior to the attachment of a spray gun, in use. The use of a filter acts to prevent the entrainment of undesirable particulates into the spray gun nozzle and consequently improves the evenness of coverage of the paint and also prevents the blockage of the nozzle.

The reservoir may have a volume of between any one pair of the following values: <25 ml, 25 ml, 30 ml, 50 ml, 75 ml, 100 ml, 150 ml, 250 ml or >250 ml.

The reservoir may be a single-use, diposable reservoir in the sense that it is intended to be thrown away when the fluid has been used and is not intended to be cleaned and re-used with another fluid. However, fluid contained in the reservoir may be stored by releasably sealing the reservoir to enable the fluid to be used when required, for example when applying multiple coats with the same fluid to allow drying in-between. The reservoir may substantially prevent the escape of solvent vapour.

The body of the reservoir may be substantially made of plastics material selected, for example from the group comprising polyethylene and polypropylene. This together with the relatively low volume of the reservoir referred to previously produces a simple, compact, lightweight construction of reservoir that is especially suitable for use with hand held spray guns. The plastics material may be opaque for use with light sensitive fluids. Alternatively, the plastics material may be substantially transparent or translucent or provided with a transparent or translucent window for inspecting the contents of the reservoir and the body may have a scale marking to indicate a volume of fluid within the reservoir.

According to a second aspect of the present invention there is provided a fluid reservoir comprising fluid retention means for detachable connection to a spray gun, and vacuum forming means for creating a partial vacuum (pressure differential) within the fluid retention means so as to draw a fluid into the retention means, in use, and means for releasing the partial vacuum to allow the fluid to be withdrawn from the reservoir when connected to the spray gun.

The fluid retention means may comprise a syringe body with the vacuum forming means being a plunger slidable in the body to draw the fluid into the body via an open end. The means for releasing the partial vacuum may be an airway for connecting the partial vacuum to atmospheric pressure externally of the reservoir.

Preferably, the airway is arranged to release the partial vacuum without removing the plunger from the body. For example, the airway may be formed by an aperture in the wall of the body and the plunger can be withdrawn to release the partial vacuum via the aperture. In this way, fluid may be withdrawn from the body without applying an actuation force to the plunger externally of the body to move the plunger towards the open end.

Advantageously, the syringe body and plunger form a single-use disposable reservoir that can be thrown away after use. Alternatively, the open end of the syringe body may be sealed releasably by a detachable closure so that the fluid can be stored until required for use.

According to a third aspect of the present invention there is provided a fluid reservoir for a spray gun, the reservoir comprising a body having a first, substantially closed end and a second, open end, the open end being connectable, in use, to a spray gun, and a vacuum forming element operable to create at least a partial vacuum within the body for drawing fluid into the reservoir via the open end when disconnected from the spray gun characterised in that the vacuum forming element is manually operable to draw fluid into the reservoir via the open end and the reservoir is adapted, when connected to the spray gun, so that fluid can be withdrawn from the reservoir via the open end for supply to the spray gun without operation of the vacuum forming element.

According to a fourth aspect of the present invention there is provided a fluid reservoir for a spray gun, the reservoir comprising a compact, lightweight syringe of low volume having a syringe body connectable to a spray gun via an opening at one end, a plunger reciprocal in the body for manually drawing fluid into a fluid chamber within the body via the opening when disconnected from the spray gun, and an openable airway for connecting the fluid chamber to atmosphere to allow transfer of fluid from the fluid chamber to the spray gun, in use.

According to a fifth aspect of the present invention there is provided a spray gun adapted to include a reservoir according to any of the first, second, third and fourth aspects of the present invention.

The spray gun may be a gravity fed spray gun. Alternatively, it may be a pressure feed spray gun.

According to a sixth aspect of the present invention there is provided a method of providing a paint reservoir adaptable for use with spraying apparatus including the steps of:

i) providing a body open at one end;

ii) providing a vacuum forming element;

iii) placing the open end in a paint;

iv) forming an at least partial vacuum (pressure differential) within the body using the vacuum forming element;
v) drawing paint into the body by the partial vacuum;
vi) retaining the paint in the body until such time as it is required to be used; and
vii) releasing the partial vacuum to allow the paint to be withdrawn from the reservoir when connected to the spraying apparatus.

The method may further include withdrawing the paint from the reservoir in use of the spraying apparatus. The method may further include the step of providing an adapter to adapt the body for connection to the spraying apparatus. The method may further include the step of providing the reservoir in combination with the spraying apparatus. The method may further include releasably sealing the open end of the body with the paint inside, in use. The spraying apparatus may be a spray gun.

According to a seventh aspect of the present invention, there is provided a method of spraying a vehicle comprising the steps of:
a) preparing a paint mix;
b) withdrawing a portion of the paint mix into a disposable reservoir of low volume;
c) attaching the reservoir to a spray gun;
d) spraying a test card;
e) comparing the test card with a vehicle to be spray painted;
f) repeating steps (b) to (e) as necessary with adjustments to the paint mix and using a new disposable reservoir when preparing each test card until a colour match is obtained between the test card and the vehicle;
g) charging the spray gun with the paint mix; and
h) spraying the vehicle.

The spray gun may have a detachable reservoir and the method further includes providing the detachable reservoir with a removable, disposable liner when charging the spray gun with paint mix in step (g).

It will be understood that the term "paint" is used herein to include all forms of paint-like coating materials that can be applied to a surface using a spray gun, whether or not they are intended to colour the surface. The term includes, for example, primers, base coats, lacquers and similar materials.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
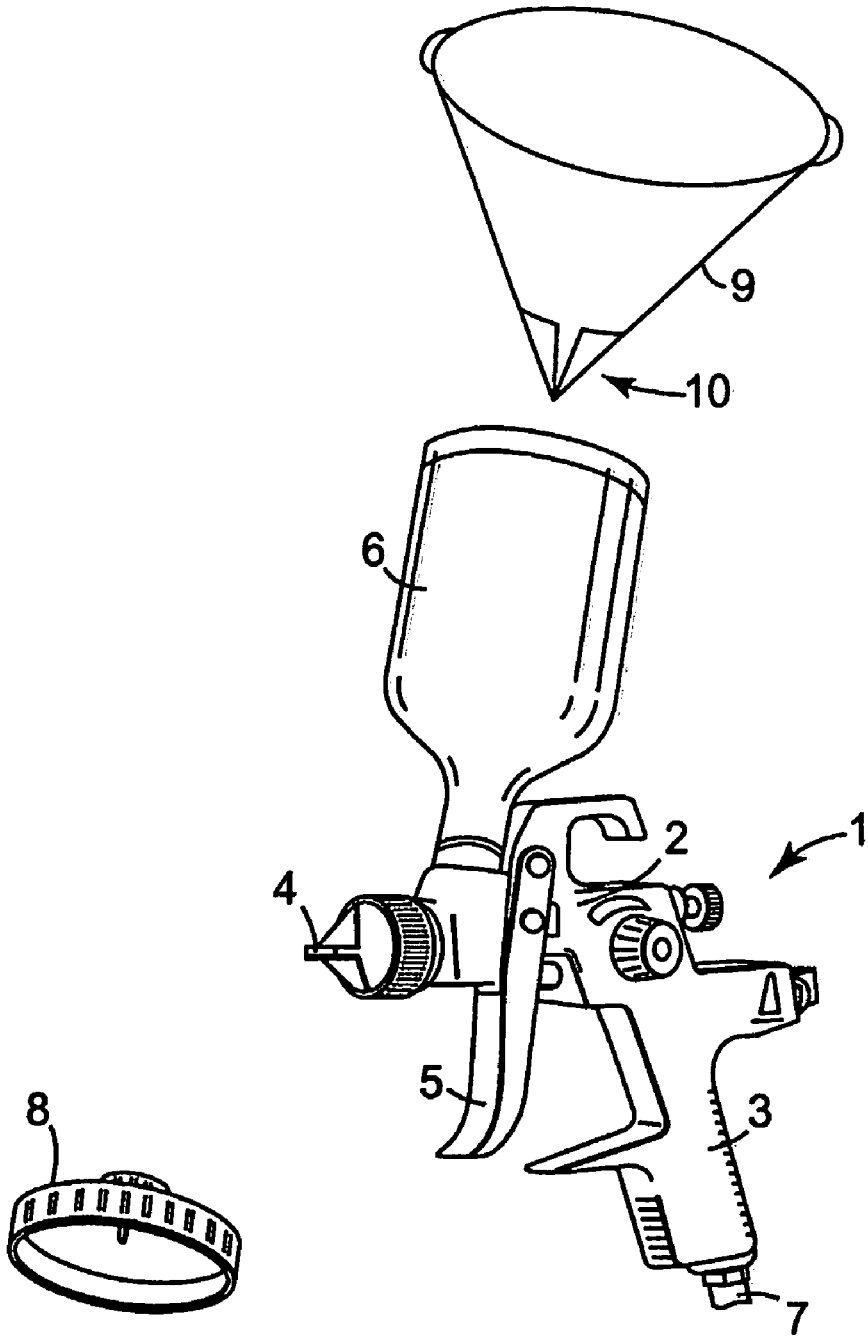
Fig. 1 PRIOR ART
FIG. 1 is a perspective view of a prior art spray gun, shown partly disassembled so that it can be filled with paint.

FIG. 1 of the drawings illustrates a typical prior art paint spray gun 1 of the gravity-feed type. The gun 1 comprises a body 2, a handle 3 which extends downwards from the rear end of the body, and a spray nozzle 4 at the front end of the body. The gun is manually operated by a trigger 5, which is pivotally mounted on the sides of the gun. The paint reservoir, or paint pot, 6 which contains paint (or similar material) to be discharged by the gun, is located on the top of the body 2 and communicates with an internal passageway (not visible) for compressed air, which extends through the gun from a connector 7 at the lower end of the handle 3 to the nozzle 4. In use, the connector 7 is connected to a source of compressed air (not shown) so that, when the user pulls on the trigger 5, compressed air is delivered through the gun to the nozzle 4. Because of the atomising effect of the compressed air, the paint, which is essentially being delivered under gravity from the pot 6, is delivered through, and from, the nozzle 4 as a spray.

The paint which is contained in the pot 6 is often mixed by hand (for which a separate receptacle, for example a jug, is required), and poured into the pot. To ensure that there are no unwanted particles in the paint, which would spoil the finish of the painted surface, the paint is usually poured into the pot 6 through a filter. FIG. 1 shows the cap 8 of the pot 6 removed for this purpose, and a conical filter 9 about to be positioned on the open end of the pot. The filter 9 is shown as being a known type of disposable conical filter, having solid sides and a filter mesh portion 10 at the pointed end of the cone. When the pot 6 has been filled with paint, the filter 9 is removed and discarded, and the cap 8 of the pot is replaced. If the filter 9 is a reusable filter then, like the gun, it should be cleaned thoroughly before it is used with a different liquid (e.g. a paint of a different colour or a liquid having a different chemical composition).

Figure 2:
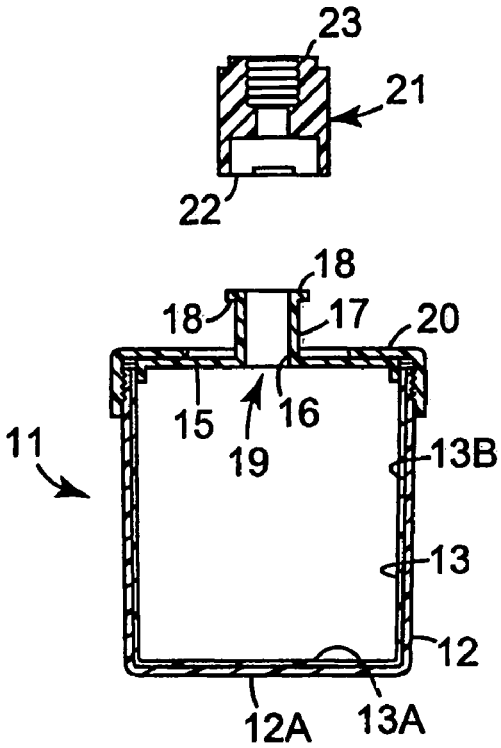
Fig. 2 PRIOR ART
FIG. 2 is a perspective view of an alternative prior art paint reservoir.
Figure 3:
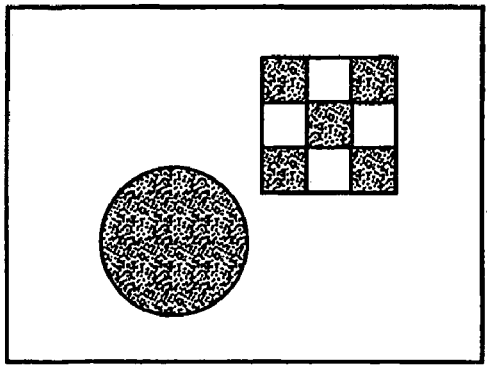
Fig. 3 PRIOR ART
FIG. 3 is a schematic representation of a 'spray out' card.

FIG. 2 illustrates the components of an alternative form of paint pot 11 which can be used on the gun 1 of FIG. 1 (or any similar gun) instead of the pot 6, as disclosed in PCT Application No. PCT/US/98/00796, the contents of which are incorporated herewith by reference.

The paint pot 11 comprises an open container 12, comparable in size to a conventional paint pot of a hand-held spray gun, having an air hole 12A in its base and provided with a disposable liner 13. The liner 13 corresponds in shape to (and is a close fit in) the interior of the container 12 and has a narrow rim 14 at the open end which sits on the top edge of the container. The container 12 also has a disposable lid 15 which is a push-fit in the open end of the liner 13. The lid 15 has a central aperture 16 from which extends a connector tube 17 provided, at its end, with outward extensions 18 forming one part of a bayonet connection. The aperture 16 is covered by a filter mesh 19 which may be a push fit into the aperture or may be an integral part of the lid 15. The lid 15 is held firmly in place on the container 12 by an annular collar 20 which screws onto the container, on top of the lid.

The paint pot 11 is attached to the spray gun 1 through the use of an adapter 21 shown, separated from the paint pot, in FIG. 2. The adapter 21 is a tubular component which, at one end 22, is formed internally with the other part of the bayonet connection for attachment to the connector tube 17 of the paint pot 11. At the other end 23, the adapter is shaped to match the standard attachment of the spray gun paint pot (typically a screw thread).

The use of the collapsible liner 13 has the advantages that it is not necessary to clean the pot 12 between uses in order to prevent cross-contamination and its use within the pot 12 allows the rigidity and ease of handling associated with these systems to be maintained.

Figure 4:
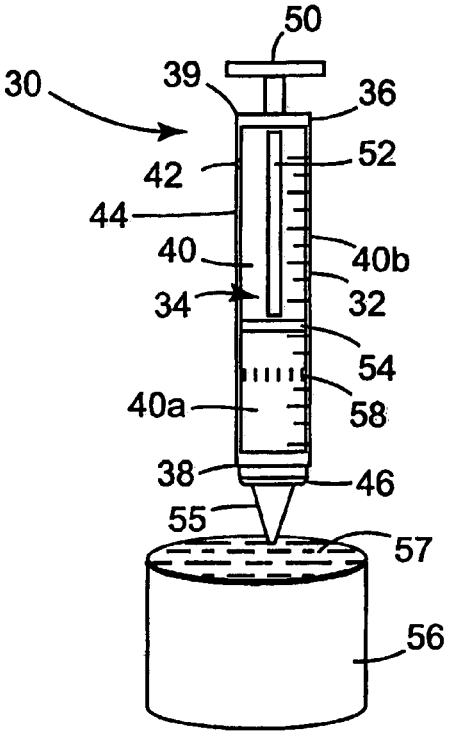
FIG. 4 shows a syringe type paint reservoir according to an aspect of the present invention, in use, with a bulk paint container.

FIG. 4 shows a first embodiment of the present invention in which a reservoir 30 comprises a syringe body 32 of substantially circular cross-section and a plunger 34.

The syringe body 32 has a substantially closed end 36 and an open end 38. The closed end 36 has an annular closure face 39. A cavity 40 extends between the closed and open ends 36, 38. The body 32 has a small aperture 42 which passes through a wall 44 thereof into the cavity 40 close to the closed end 36 of the body 32.

The open end 38 of the body 32 has a mounting 46 extending away from the body 32. The mounting may have either internal or external screw threads or have plain inner and outer surfaces, see for example FIGS. 12 and 13.

The plunger 34 has a top plate 50, an elongate shank 52, and a sealing member 54. The sealing member 54 slidably and sealably engages the inner surface of the body 32.

The shank 52 passes through the opening in the annular closure face 39 such that the top plate 50 lies externally of the body 32 and the sealing member 54 lies internally of the body 32. The sealing member 54 can be moved in an axial direction towards and away from the open end 38 of the body 32 by an actuation force applied to the plunger 34 via the top plate 50 externally of the body 32.

The sealing member 54 frictionally engages the wall of the body 32 and is usually fabricated from an elastomeric material. In effect, the sealing member 54 divides the cavity 40 into a paint chamber 40*a* and an air chamber 40*b*. The paint chamber 40*a* lies between the open end 38 and the sealing member 54. The air chamber 40*b* lies between the sealing member 54 and the closed end 36. Longitudinal movement of the sealing member 54 within the cavity 40 varies the relative lengths, and hence volumes, of the paint chamber 40*a* and the air chamber 40*b*.

The body 32 of the reservoir 30 is typically formed of a plastics material, for example polyethylene or polypropylene, and may be transparent, translucent or opaque and of any suitable size. Typically the body 32 is formed in an injection moulding process. For use with a paint spray gun as a colour match test aliquot, a reservoir having a capacity of 25 ml, 50 ml, 75 ml or 100 ml is typically used, although other capacities are envisaged for use dependent upon the intended application. Such other applications may include the painting of, for example, furniture or signs or the spraying of other fluids such as adhesives.

The top plate 50 and shank 52 are typically formed of a plastics material, for example polyethylene or polypropylene and typically are formed in an injection moulding process.

Figure 5:
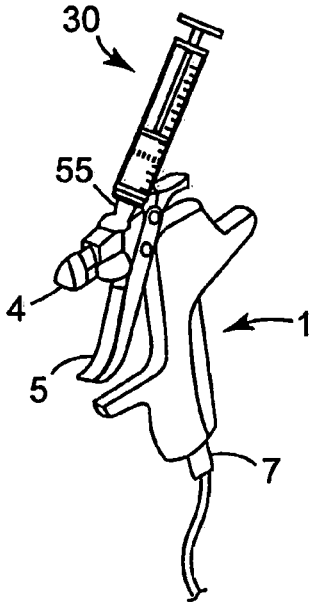
FIG. 5 is a perspective view of the paint reservoir of FIG. 4, in use, with a spray gun.

An adapter 55 is fitted to the reservoir 30 typically either by a friction fit with the mounting 46 or by use of complementary screw threads on the adapter 55 and the mounting 46 as described hereinafter, see FIGS. 13*a, b, c*. The adapter 55 is arranged to be able to fit directly into the spray gun 1 as shown in FIG. 5.

The adapter 55 is typically formed from a plastics material, for example polyethylene or polypropylene, or alternatively it may be a machined metal component, for example, formed from aluminium and anodised. The mounting 46 can be fitted with the adapter 55 to allow the reservoir 30 to be fitted to a spray gun 1 or with a closure to seal the paint chamber 40*a* as described hereinafter, see FIGS. 12*a, b, c*.

In use, the plunger 34 is advanced within the cavity 40 to position the sealing member 54 adjacent to the open end 38. The open end 38 is placed in a container 56 of paint 57. The plunger 34 is withdrawn to move the sealing member 54 away from the open end 38 towards the closed end 36. This withdrawal of the sealing member 54 creates a partial vacuum, negative pressure compared to atmospheric pressure, within the paint chamber 40*a*. This partial vacuum, draws the pre-mixed paint 57 from the bulk container 56 into the paint chamber 40*a*.

The plunger 34 is withdrawn to a position in which the sealing member 54 is between the open end 38 and the aperture 42 to draw up the required volume of paint. Air in the air chamber 40*b* is expelled through the aperture 42 so movement of the sealing member 54 is not hindered by compression of the air in the air chamber 40*b*.

The reservoir 30 is then attached to the spray gun 1 and the plunger 34 is withdrawn to a position in which the sealing member 54 is between the aperture 42 and the closed end 36. This allows air to enter the paint chamber 40*a* through the aperture 42 releasing the partial vacuum formed in the body 32 and allows paint to be withdrawn from paint chamber 40*a* without a partial vacuum forming therein during the spraying operation. In this way, the air entering the paint chamber 40*a* obviates the requirement for the plunger 34 to move to advance the sealing member 54 to expel the paint.

This is advantageous as the pressure differential associated with the entrainment of the paint into the spray gun air flow may not be sufficient by itself to draw the plunger 34 into the body due to the sealing fit of the sealing member 54 in the body. Moreover, if the plunger 34 were to stick in the body 32 after passing the aperture 42, a partial vacuum may be formed that reduces or prevents entrainment of the paint into the spray gun air flow which can result in the spray gun 1 not spraying the paint.

As will now be appreciated, the plunger 34 may be manually operable to control formation of the partial vacuum to draw fluid into the reservoir 30 and fluid can be drawn from the reservoir 30 without manual operation of the plunger 34. Moreover, the reservoir 30 is of compact, lightweight construction that facilitates holding and positioning of the spray gun 1 to direct the paint spray as desired. As a result, the reservoir 30 is easier and simpler to use than would be the case if an external actuation force had to be continuously applied to the plunger 34, ie. by a user's hand, to expel paint from the reservoir 30.

If desired, an optional filter element 58 can be included in or fitted over the open end 38 of the syringe body 32 in order to prevent the entrainment of particulates into the paint as it is drawn into the body 32. This prevents particles blocking the spray gun 1 and degrading the characteristics and finish of the paint 57.

Figure 6A:
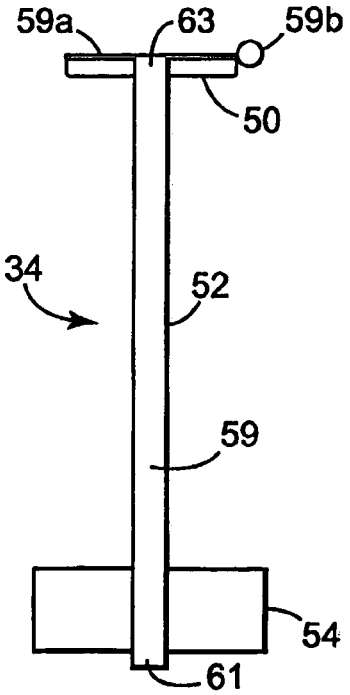
FIGS. 6*a*, 6*b* are schematic representations of alternative embodiments of a plunger of the reservoir of FIG. 4.
Figure 6B:
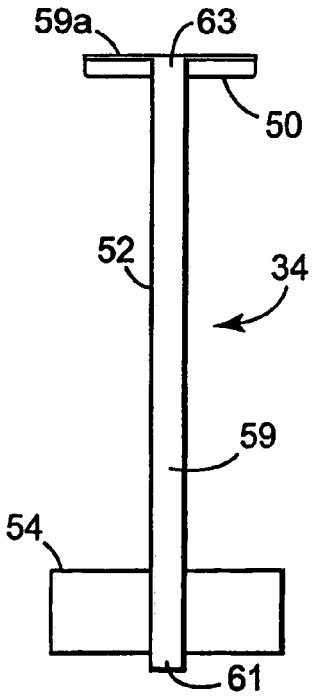

In alternative embodiments, shown in FIGS. 6*a* and 6*b*, the aperture 42 may be omitted and the plunger 34 is provided with a shank 52 having an internal passageway 59 including a first opening 61 and a second opening 63. The passageway 59 provides an airway that connects the paint chamber 40*a* to atmosphere externally of the body 32 and is closable by a cover 59*a* located on the top plate 50.

The cover 59*a* is typically sealingly attached to the outer face of the top plate 50 of the plunger 34 such that it covers the opening 63 of passageway 59. The cover 59*a* may either be pivotally mounted upon a hinge 59*b* attached to a side of the top plate 50 (FIG. 6*a*) or frictionally engage the top plate 50 (FIG. 6*b*).

The cover 59*a* is attached to the top plate 50 to close the passageway 59 as paint is drawn into the body 32 so as to prevent air entering the paint chamber 40*a*. Air in the air chamber 40*b* may escape between the shank 52 of the plunger 34 and the opening in the closure face 39. Alternatively, an aperture may be provided in the wall or closure face for this purpose.

Once the desired paint fill level of the chamber 32 has been reached the reservoir 30 can be attached to a spray gun 1 as described previously and cover 59*a* removed from the top plate 50. This places the paint chamber 40*a* in communication with atmosphere externally of the body 34 and allows air to enter the paint chamber 40*a* releasing the partial vacuum formed therein. Again, this advantageously allows paint to be withdrawn from the reservoir 30 during operation of the spray gun 1 without applying any external force to the plunger 34.

In use, the spray gun trigger 5 is depressed and air is drawn from the source of compressed air (not visible) through the connector 7 which atomises the paint 57 and passes it out via the spray nozzle 4. Upon completion of spray painting the reservoir 30 can be removed from the spray gun 1.

If the paint 57 is a match to the desired colour, the paint 57 can be returned to the bulk container 56 and the reservoir 30 disposed of. Alternatively, the reservoir 30 can be sealed to store the paint 57 contained within the chamber 40*a* for later use.

If the paint 57 does not match the desired colour it is returned to the bulk container 56, and tinted further. The reservoir 30 is discarded to prevent cross-contamination between aliquots of tints. The spray gun 1 is cleaned and a further aliquot of paint is then drawn up using another reservoir 30 for test spraying in the same manner until a colour match is obtained.

Figure 7:
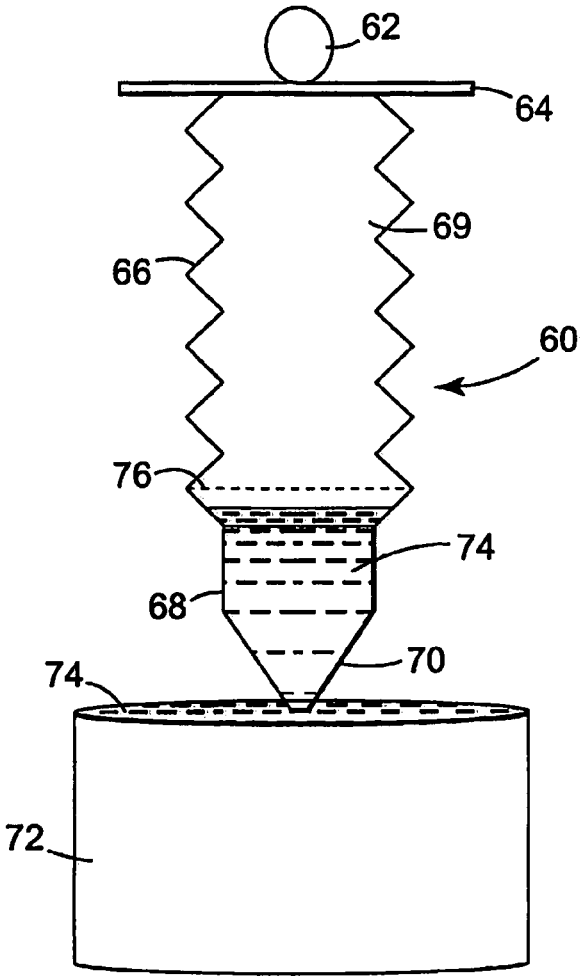
FIG. 7 shows a collapsible paint reservoir according to another aspect of the present invention in an, at least partially, extended configuration in use with a bulk paint container.
Figure 8:
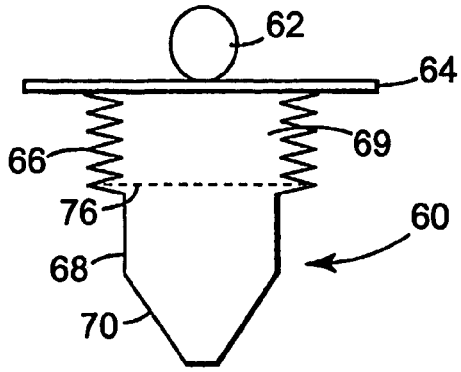
FIG. 8 shows the collapsible paint reservoir of FIG. 7 in its collapsed configuration.
Figure 9:
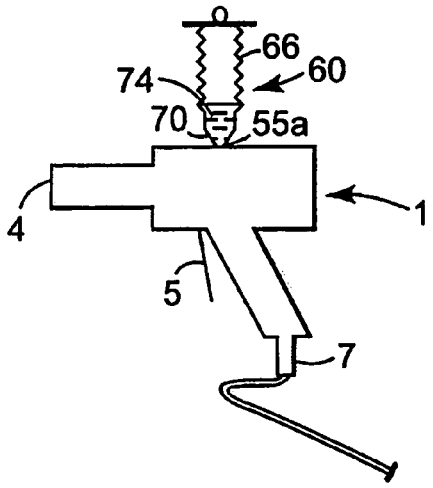
FIG. 9 shows the paint reservoir of FIGS. 7 and 8, in use, with a spray gun.

In an alternative embodiment, shown in FIGS. 7, 8 and 9, a collapsible, concertina-type reservoir 60 is employed and comprises a handle 62 attached to a closed end 64 and a bellows 66 extending between the closed end and an open end 68.

The closed end 64 seals one end of the bellows 66 so as to form a cavity 69 which opens to its surroundings via the open end 68. The open end 68 includes a mounting 70 which can be fixed to an adapter 55*a*, as shown in FIG. 9, or have a closure fitted thereto in a similar fashion to the mounting 46 of the first embodiment.

The bellows 66 are typically made from a plastics material such as polyethylene or polypropylene. The capacity of the reservoir 60 is typically 25 ml, 50 ml, 75 ml or 100 ml, but it is envisaged that any volume could be used dependent upon the application for which the reservoir 60 is to be used.

In use, the bellows 66 of the reservoir 60 are initially in a compressed configuration, see FIG. 8. The end section 68 is inserted into a container 72 of paint 74. The handle 62 is drawn away from the end section 68 thereby extending the bellows 66. As the bellows 66 are extended a partial vacuum, negative pressure relative to atmospheric pressure, is formed within the bellows 66. This partial vacuum draws the paint 74 into the cavity 69, see FIG. 7. Extension of the bellows 66 may be operated manually.

The bellows 66 may then be attached to a spray gun 1, see FIG. 9, and the paint 74 is withdrawn from the reservoir 60 during operation of the spray gun 1. In this embodiment, the concertina-type construction of the reservoir 60 is such that the bellows 66 collapse and return to their compressed configuration as the paint 74 is withdrawn from the reservoir 60 independently of an external actuation force being applied to the closed end 64. In this way, the collapse of the bellows 66 controls the partial vacuum created when drawing paint 74 into the reservoir 60 and ensures withdrawal of the paint 74 during operation of the spray gun 1 is not restricted or prevented.

Upon completion of spray painting the reservoir 60 can be removed from the spray gun 1. If the paint 74 is a match to the desired colour, the paint 74 can be returned to the bulk container 72 and the reservoir 60 disposed of. Alternatively, the reservoir 60 can be sealed so as to store the paint 74 contained within the cavity 69 for later use.

If the paint 74 does not match the desired colour it is returned to the bulk container 72, and tinted further. The reservoir 60 is discarded to prevent cross-contamination between aliquots of tints. The spray gun 1 is cleaned and a further aliquot of paint is then drawn up using another reservoir 60 for test spraying in the same manner until a colour match is obtained.

If desired, an optional filter element 76 can be included in or fitted over the open end 68 of the reservoir 60 in order to prevent the entrainment of particulates into the paint 74 drawn into the reservoir 60. This prevents the spray gun 1 being blocked with particles and/or the characteristics and finish of the paint 74 being degraded by entrained particles.

Figure 10:
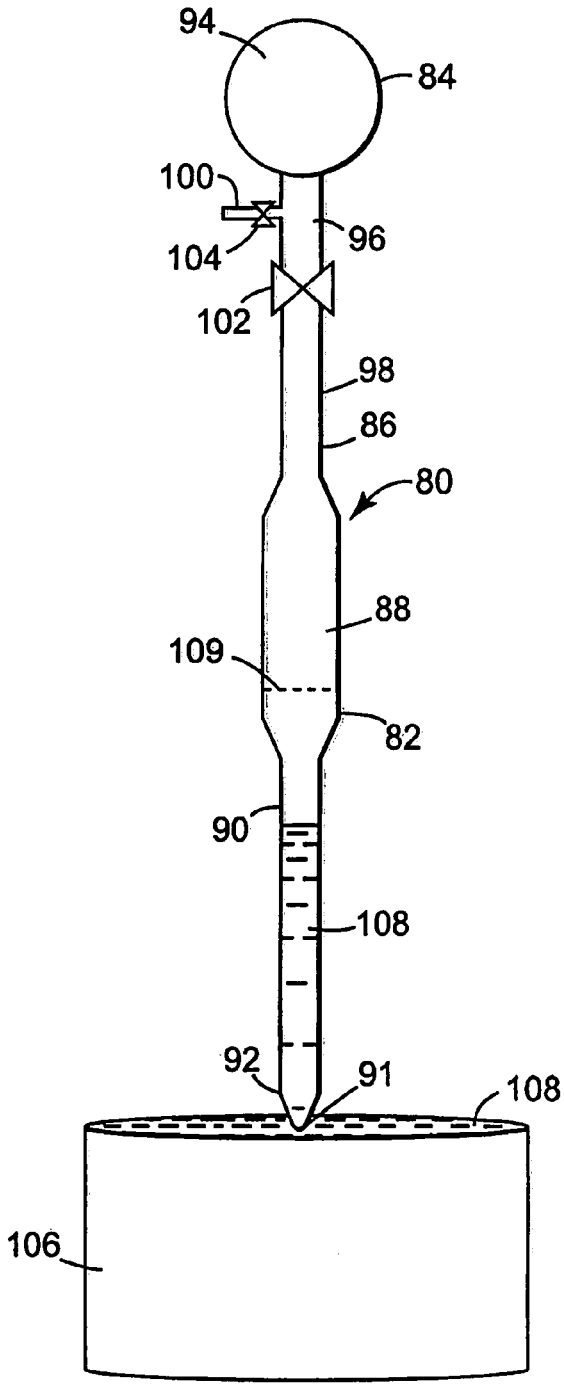
FIG. 10 shows a pipette type paint reservoir according to yet another aspect of the present invention, in use, with a bulk paint container.
Figure 11:
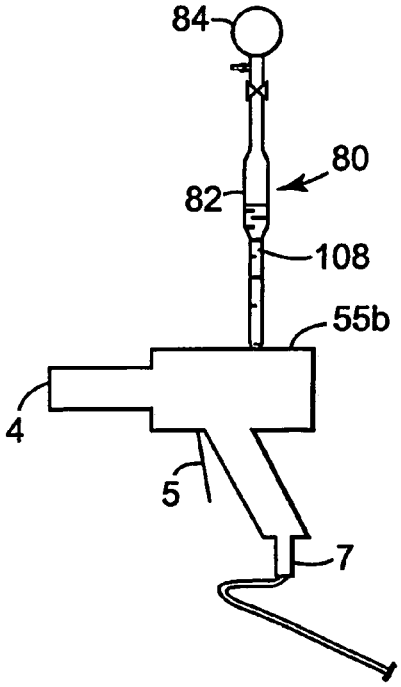
FIG. 11 shows the paint reservoir of FIG. 10, in use with a spray gun.

In another alternative embodiment shown in FIGS. 10 and 11, a reservoir 80 is employed comprising a pipette body 82 and a filler 84.

The pipette 82 is substantially circular in cross section and has an elongate upper section 86, a distended mid-section 88, an elongate lower section 90 with an open end 91 and a mounting 92.

The mounting 92 is the same as that described for the previous embodiments and can have a closure fitted as described hereinafter or can be fixed to an adapter 55*b* that allows the reservoir 80 to be fitted to a spray gun 1, see FIG. 11.

The filler 84 has a generally spherical, elastomeric bulb 94 and a tube 96 extending from the bulb 94 which is open at an end 98 remote from the bulb 94 and fits on the upper section 86 of the body 82. The tube 96 has a spur 100 which projects at right angles to the tube 96. The tube 96 has a valve 102 situated between the end 98 and the spur 100. The spur 100 has a valve 104 therein.

The pipette 82 is typically made of a plastics material, for example, polyethylene or polypropylene. Alternatively, the pipette may be made of glass. The capacity of the reservoir is typically 25 ml, 50 ml, 75 ml or 100 ml, but it is envisaged that any volume could be used dependent upon the application for which the reservoir 80 is to be used.

In use, valve 102 is closed and the valve 104 is opened allowing air to be expelled from the bulb 94 by manual compression of the bulb 94 to force air from the bulb 94 through the spur 100 and open valve 104. The valve 104 is closed once the desired amount of air has been expelled forming a partial vacuum, negative pressure when compared to atmospheric, in the bulb 94.

The open end 91 of the lower section 90 of the pipette 82 is inserted into a bulk container 106 of paint 108. The valve 102 is opened and the negative pressure in the bulb 94 draws the paint 108 into the reservoir 80. The valve 102 is closed when the required volume of paint 108 has been drawn into the reservoir 80. Typically the major portion of the paint stored in the reservoir 80 is stored in the mid-section 88.

The reservoir 80 is mounted on the spray gun 1 and trigger 5 is depressed. Air is drawn from the source of compressed air (not visible) through the connector 7 and passes to the spray nozzle 4 where it forms a spray of atomised paint with the paint 108 withdrawn from the reservoir 80. The valves 102, 104 are opened during the spraying procedure to release the partial vacuum formed in the pipette body 82 and prevent the formation of a vacuum within the reservoir 80 which could eventually prevent the withdrawal of the paint 108 from the reservoir 80. Furthermore, opening the valves 102,104 allows paint to be withdrawn from the pipette 82 without applying an external force to the bulb 94 during spray painting.

Upon completion of spray painting the reservoir 80 can be removed from the spray gun 1. If the paint 108 is a match to the desired colour the paint 108 can be returned to the bulk container 106 and the reservoir 80 disposed of. Alternatively, the reservoir 80 can be sealed so as to store the paint 108 contained within it for later use.

If the paint 108 does not match the desired colour it is returned to the bulk container 106, and tinted further. The reservoir 80 is discarded to prevent cross-contamination between aliquots of tints. The spray gun 1 is cleaned and a further aliquot of paint is then drawn up using another reservoir 80 for test spraying in the same manner until a colour match is obtained.

If desired, an optional filter element 109 can be included in or fitted over the open end 91 of the reservoir 80 to prevent the entrainment of particulates in the paint 108 drawn into the reservoir 80. This prevents the spray gun 1 being blocked with particles and/or the characteristics and finish of the paint 108 being degraded by entrained particles.

In each of the above-mentioned embodiments the respective mountings 46,70,92 may have an internal screw thread 110 engageable with a complementary external screw thread 120 of a closure 118 (see FIG. 12*a*) to seal fluid within the reservoir until required for use.

Alternatively the respective mountings 46,70,92 may have an external screw thread 112 engageable with a complementary internal screw thread 124 of a closure 122 (see FIG. 12*b*) to seal fluid in the reservoir until required for use.

Alternatively, the mountings 46,70,92 may have plain internal 114 and external 116 surfaces having no screw threads and a closure 126 is provided having a smooth external face 128 which is a push-fit to frictionally engage the internal surface 114 (see FIG. 12*c*) to seal the fluid in the reservoir 30,60,80.

Figure 12A:
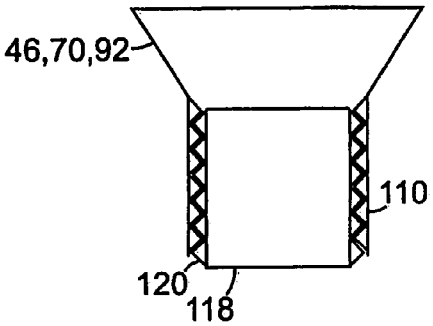
FIGS. 12*a*, 12*b*, 12*c* are schematic representations of alternative closure mechanisms for a paint reservoir according to any aspect of the present invention.
Figure 12B:
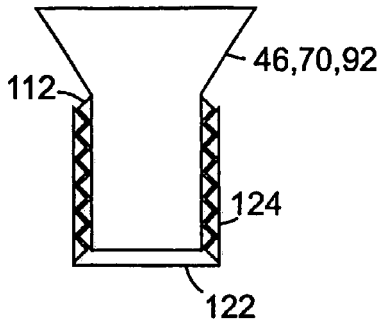
Figure 12C:
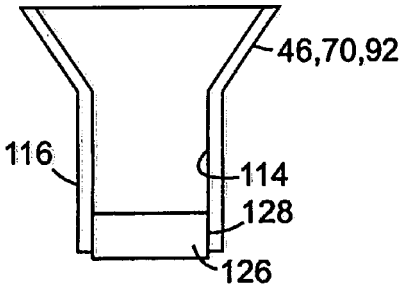
Figure 13A:
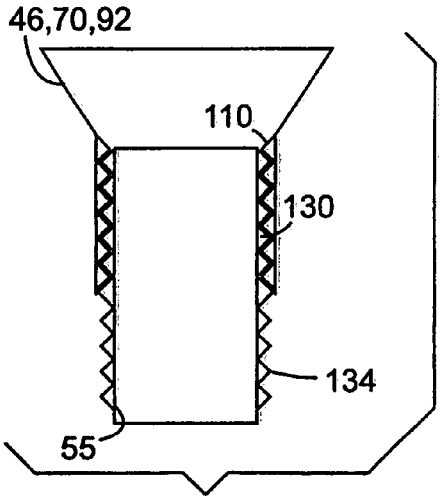
FIGS. 13*a*, 13*b*, 13*c* are schematic representations of alternative adapters for a paint reservoir according to the present invention.
Figure 13B:
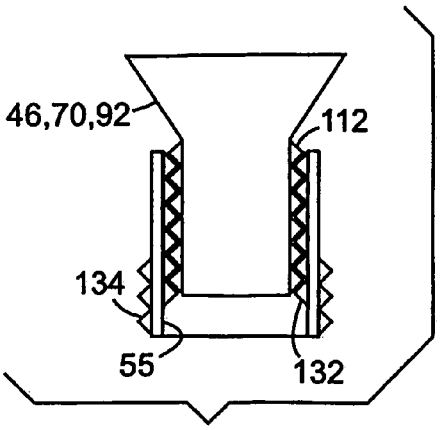
Figure 13C:
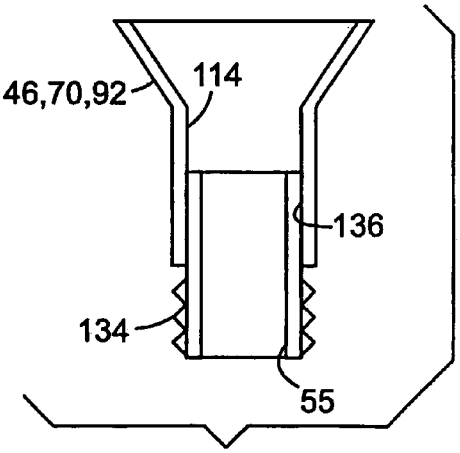

FIGS. 13*a*, 13*b* and 13*c* show the mountings 46,70,92 of FIGS. 12*a*, 12*b* and 12*c* with the closures 118,122 and 126 detached and the mountings 46, 70, 92 connected to the appropriate adapter 55,55*a*,55*b* for connection to the spray gun 1.

In FIG. 13*a*, the adapter has an external screw thread 130 engageable with the internal screw thread 110 of the mounting 46,70,92 and with an internally threaded portion of the spray gun mounting (not shown).

In FIG. 13*b*, the adapter has an internal screw thread 132 engageable with the external screw thread 112 of the mounting 46,70,92 and an external screw thread 134 engageable with an internally threaded portion of the spray gun mounting (not shown).

In FIG. 13*c*, the adapter has a smooth outer surface 136 that is a push fit within the smooth inner surface 114 of the mounting 46,70,92 and an external screw thread 134 disposed externally of the mounting 46,70,92. The external screw thread 134 is engageable with an internally threaded portion of the spray gun mounting (not shown).

Alternatively, the reservoirs 30,60,80 may be attached to the spray gun using the bayonet-screw threaded arrangement as disclosed in PCT Application No. PCT/US98/00796 or any in other manner which ensures interoperability between the system disclosed therein and reservoirs made according to the present invention.

The reservoir according to this invention may be used in instances where only a small amount of paint is required so as to minimise usage and wastage of paint. For example, when spray painting a test card to obtain a colour match or when spray painting small areas of a vehicle or other object.

It will be appreciated that the disposable nature of a reservoir according to this invention greatly reduces the amount of cleaning associated with prior art systems thereby making the changing of colours much easier and quicker. This is of particular importance when trying to obtain a colour match that may require many iterations of tinting to achieve a match.

It will further be appreciated that the disposable nature of a reservoir according to this invention and the associated reduction in cleaning will reduce the amount of solvents used with attendant benefits both to users health and the environment.

Other uses of a reservoir for delivering small volumes of a fluid to a spray gun in a variety of applications will be apparent to those skilled in the art.

It will also be appreciated that the exemplary embodiments described herein are intended to illustrate the diverse range and application of the invention and that features of the embodiments may be employed separately or in combination with any other features of the same or different embodiments to produce any desired reservoir and/or reservoir spray gun combination.

Moreover, while the specific materials and/or configuration of the reservoirs described and illustrated are believed to represent the best means currently known to the applicant, it will be understood that the invention is not limited thereto and that various modifications and improvements can be made within the spirit and scope of the claims.

What is claimed is:

1. A fluid reservoir for a spray gun, the reservoir comprising a syringe body having a first, substantially closed end and a second, open end, the open end being connectable, in use, to a spray gun, and a plunger having a sealing member resident in the body and a shank passing through an opening in the first end operable to create at least a partial vacuum within the body for drawing fluid into the reservoir via the open end when disconnected from the spray gun, characterised in that means is provided for controlling the at least partial vacuum, wherein the means for controlling the at least partial vacuum comprises an aperture through a wall of the body proximate the first end of the body such that, in use, the scaling member can be moved away from the second, open end to a first position between the second, open end and the aperture to draw fluid into the reservoir, and to a second position between the aperture and the first, closed end to allow fluid to be withdrawn from the reservoir via the second, open end whereby, when the oven end of the reservoir is connected to the spray gun, fluid can be withdrawn from the reservoir via the open end for supply to the spray gun independently of an actuation force applied to the plunger externally of the reservoir.

2. A fluid reservoir as claimed in claim 1 wherein the means for controlling the at least partial vacuum comprises a passageway extending through the plunger from the sealing member within the body to a position externally of the body, and a releasable closure for opening/closing the passageway such that in use, the passageway is closed by the closure to allow fluid to be drawn into the body by movement of the sealing member away from the second, open end and is opened by releasing the closure to allow fluid to be withdrawn front the second, open end.

3. A fluid reservoir as claimed in claim 1 wherein the body is a collapsible concertina-type body of which the first, closed end constitutes the vacuum forming element such that fluid can be draw into the body by the partial vacuum created by movement of the closed end away from the open end, and the means for controlling the partial vacuum is provided by the collapsible body.

4. A fluid reservoir as claimed in claim 1 wherein the body is a pipette having a filler at the first, closed end providing the vacuum forming element for drawing fluid into the body, and valve means for controlling the partial vacuum to allow the fluid to be withdrawn from the body.

5. A fluid reservoir as claimed in claim 1 wherein the second, open end of the body is provided with a mounting adapted for releasably connecting the second, open end to a spray gun in use or a closure for sealing the reservoir.

6. A fluid reservoir as claimed in claim 5 wherein an adapter is provided for releasably attaching the mounting to a spray gun, in use.

7. A fluid reservoir as claimed in claim 1 wherein the reservoir has a volume of at least 100 ml.

8. A fluid reservoir as claimed in claim 1 wherein the reservoir is a single-use, disposable reservoir.

9. A fluid reservoir as claimed in claim 1 wherein the reservoir substantially prevents the escape of solvent vapour from a solution, or mixture, in use.

10. A fluid reservoir as claimed claim 1 wherein the body is substantially made of a plastics material.

11. A fluid reservoir as claimed in claim 10 wherein the body is substantially transparent or translucent or has a transparent or translucent window and is provided with a scale marking to indicate a volume of fluid within the body.

12. A spray gun comprising a fluid reservoir according to claim 1.

13. A spray gun according to claim 12 wherein the spray gun is a hand-held gravity feed or pressure feed spray gun.

14. A fluid reservoir as claimed in claim 1 wherein the sealing member slidably and sealably engages a wall of the body to divide the syringe body into two chambers, and movement of the plunger away from the second, open end towards the first end creates the at least partial vacuum in the body for drawing fluid into the reservoir.

15. A method of spraying a vehicle comprising the steps of:

a) preparing a paint mix;

b) forming an at least partial vacuum within a disposable reservoir of low volume and withdrawing a portion of the paint mix into the reservoir by moans of a vacuum forming element;

c) attaching the reservoir to a spray gun;

d) controlling the at least partial vacuum to allow the paint to be withdrawn from the reservoir without actuating the vacuum forming element to expel the paint and spraying a test card;

e) comparing the test card with a vehicle to be spray painted;

f) repeating steps (b) to (e) as necessary with adjustments to the paint mix and using a new disposable reservoir when preparing each test card until a colour match is obtained between the test card and the vehicle;

g) charging the spray gun with the paint mix; and h) spraying the vehicle.

16. A method according to claim 15 wherein the spray gun has a detachable reservoir and the method further includes providing the detachable reservoir with a removable, disposable liner when charging the spray gun with paint mix in step (g).

* * * * *

UNITED STATES PATENT AND TRADEMARK OFFICE

CERTIFICATE OF CORRECTION

PATENT NO. : 7,143,960 B2
APPLICATION NO. : 10/471709
DATED : December 5, 2006
INVENTOR(S) : Stephen C. P. Joseph It is certified that error appears in the above-identified patent and that said Letters Patent is hereby corrected as shown below:

Column 1 – Line 4 - Delete "FILED" and insert -- FIELD --, therefor.

Column 1 – Line 62 - Delete "No." and insert -- No: --, therefor.

Column 3 – Line 39 - Delete "arid" and insert -- and --, therefor.

Column 10 – Line 56 - Delete "ie." and insert -- i.e. --, therefor.

Column 14 – Line 60 - In Claim 1, delete "scaling" and insert -- sealing --, therefor.

Column 14 – Line 65 - In Claim 1, delete "oven" and insert -- open --, therefor.

Column 15 – Line 8 - In Claim 2, after "that" insert -- , --.

Column 15 – Line 12 - In Claim 2, delete "front" and insert -- from --, therefor.

Column 15 – Line 39 - In Claim 10, after "claimed" insert -- in --.

Column 16 – Line 19 (Approx.) - In Claim 15, delete "moans" and insert -- means --, therefor.

Signed and Sealed this

Tenth Day of April, 2007

JON W. DUDAS
*Director of the United States Patent and Trademark Office*